US009303933B1

(12) United States Patent
Lewis, III

(10) Patent No.: US 9,303,933 B1
(45) Date of Patent: Apr. 5, 2016

(54) BOLT CARRIER GAS IMPINGEMENT SYSTEM

(71) Applicant: Herbert W. Lewis, III, Macclesfield, NC (US)

(72) Inventor: Herbert W. Lewis, III, Macclesfield, NC (US)

( * ) Notice: Subject to any disclaimer, the term of this patent is extended or adjusted under 35 U.S.C. 154(b) by 0 days.

(21) Appl. No.: 14/592,394

(22) Filed: Jan. 8, 2015

(51) Int. Cl.
*F41A 5/28* (2006.01)
*F41A 5/24* (2006.01)
*F41A 5/26* (2006.01)

(52) U.S. Cl.
CPC ... *F41A 5/24* (2013.01); *F41A 5/26* (2013.01); *F41A 5/28* (2013.01)

(58) Field of Classification Search
CPC ..... F41A 5/28; F41A 5/26; F41A 5/24; F41A 5/18
USPC ..... 89/191.01, 191.02, 192, 193
See application file for complete search history.

(56) References Cited

U.S. PATENT DOCUMENTS

2015/0226502 A1* 8/2015 Beaty ..... F41A 5/28 89/193
2015/0241149 A1* 8/2015 McMillen, IV ..... F41A 5/28 89/193

* cited by examiner

*Primary Examiner* — Stephen M Johnson
(74) *Attorney, Agent, or Firm* — Ward and Smith, P.A.; Ryan K. Simmons

(57) ABSTRACT

A bolt carrier gas impingement system is provided. The bolt carrier gas impingement system may include a bolt carrier assembly including a bolt carrier and a bolt; a gas key having a gas passageway; a gas tube configured for routing gas from a discharged round to a gas key tube and the gas passageway of the gas key; and a bypass duct formed in the bolt carrier, wherein the bypass duct may be configured to provide a duct between the gas passageway and an exterior of the bolt carrier assembly, such that the discharged gas flows out of the bypass duct without contacting internal components of the bolt carrier assembly.

19 Claims, 4 Drawing Sheets

BOLT CARRIER GAS IMPINGEMENT SYSTEM

FIELD OF THE INVENTION

The invention generally relates to a bolt carrier gas impingement system for use in automatic and semi-automatic firearms, such as an AR-15 and the like. More specifically, to a bolt carrier impingement system that substantially reduces/eliminates buildup of carbon and debris on the bolt and bolt carrier of a bolt carrier assembly.

BACKGROUND OF THE INVENTION

Automatic and semi-automatic firearms, such as a standard AR-15 and the like, are operated using a gas impingement system. The gas impingement system directs gas from a fired cartridge into an interior region of the bolt carrier assembly (i.e., an impingement chamber directly behind the bolt) to cycle the firearm, i.e., to drive back the bolt carrier assembly ejecting the spent shell. In particular, in a standard AR-15 firearm, for example, the gas is vented directly into the interior of the bolt carrier assembly into an impingement chamber directly behind the bolt to force the bolt carrier assembly rearward. One problem with such a direct gas impingement system is the gas, which is hot propellant gases, carries carbon and other debris (e.g., powder residue) that over time can build up on the bolt and bolt carrier in the interior of the bolt carrier assembly and potentially slow down and/or stop the operation of the bolt and carrier. This may occur even with frequent cleaning and the operation of the bolt and carrier may slow and/or stop operation during long periods of use.

Further, these gases that are vented into interior region of the bolt carrier assembly enter at very high temperatures. These hot gases accelerate the breakdown of the various lubricants and coatings in the bolt carrier assembly, which, again, over time increases wear tear of the firearm, thus, shortening its lifetime and increasing its likelihood of failing during operation (e.g., jamming).

Therefore, there is a need for a gas impingement system that reduces or eliminates the buildup of carbon and debris on the bolt and bolt carrier in the interior region of the bolt carrier assembly. There is also a need for a gas impingement system that will reduce or eliminate the degradation of the various lubricants and coatings in the bolt carrier assembly caused by exposure to such high temperatures gases.

SUMMARY OF THE INVENTION

In one embodiment a bolt carrier gas impingement system is provided. The bolt carrier gas impingement system may include a bolt carrier assembly including a bolt carrier and a bolt; a gas key having a gas passageway; a gas tube configured for routing gas from a discharged round to the gas passageway of the gas key; and a bypass duct formed in the bolt carrier, wherein the bypass duct may be configured to provide a duct between the gas passageway and an exterior of the bolt carrier assembly, such that the discharged gas flows out of the bypass duct without contacting internal components of the bolt carrier assembly. The internal components of the bolt carrier assembly may include the bolt and internal surfaces of the bolt carrier. The bypass duct may further include an adjustable vent operably connected thereto. The adjustable vent may include orifices of differing sizes; and an adjustment mechanism configured for selecting between the orifices. The orifices may be configured such that when one of the orifices is selected using the adjustment mechanism the selected orifice aligns with an exit end of the bypass duct. The orifices sizes may be calibrated to allow for venting in the range of 0% to 100% of the discharged gas from the bypass duct. The adjustment mechanism may include three orifices of differing sizes. The adjustment mechanism may be an adjustment dial. The percentage of discharged gas to be vented may be calibrated to achieve proper actuation of the bolt carrier assembly based on a particular powder load of a round to be fired. The gas passage way may include one or more angled sections, wherein the discharged gas impinges against at least one of the one or more angled sections causing the bolt carrier assembly to actuate. The one or more angled sections may be in the range of about 45° to about 135°. The one or more angled sections may be in the range of about 90° to about 135°. The gas key may include a portion having an upper passage way and a lower passage way, wherein the upper and lower passage ways may be separated by a partition, and wherein the partition may include a port allowing the discharged gas to flow therethrough. The gas key may include one or more access hole plugs.

In another embodiment a firearm is provided. The firearm may include a bolt carrier gas impingement system. The bolt carrier gas impingement system may include a bolt carrier assembly, having a bolt carrier and a bolt. The bolt carrier gas impingement system may further include a gas key having a gas passageway; a gas tube configured for routing gas from a discharged round to the gas passageway of the gas key; and a bypass duct formed in the bolt carrier, wherein the bypass duct may be configured to provide a duct between the gas passageway and an exterior of the bolt carrier assembly, such that the discharged gas vents out of the bypass duct without coming into contact with the bolt. The firearm may be an automatic or semi-automatic firearm.

In yet another embodiment a method of actuating a bolt carrier assembly is provided. The method may include, providing a bolt carrier gas impingement system; routing discharged gas from a discharged round along a gas passageway; impinging the discharged gas against an angled portion of the gas passageway actuating the bolt carrier assembly; and venting the discharged gas externally of the bolt carrier assembly via a bypass duct, wherein the bypass duct is configured to bypass the internal components of the bolt carrier assembly such that the discharged gas does not contact internal components of the bolt carrier assembly. The internal components of the bolt carrier assembly may include a bolt and internal surfaces of a bolt carrier.

BRIEF DESCRIPTION OF THE DRAWINGS

Figure 1:
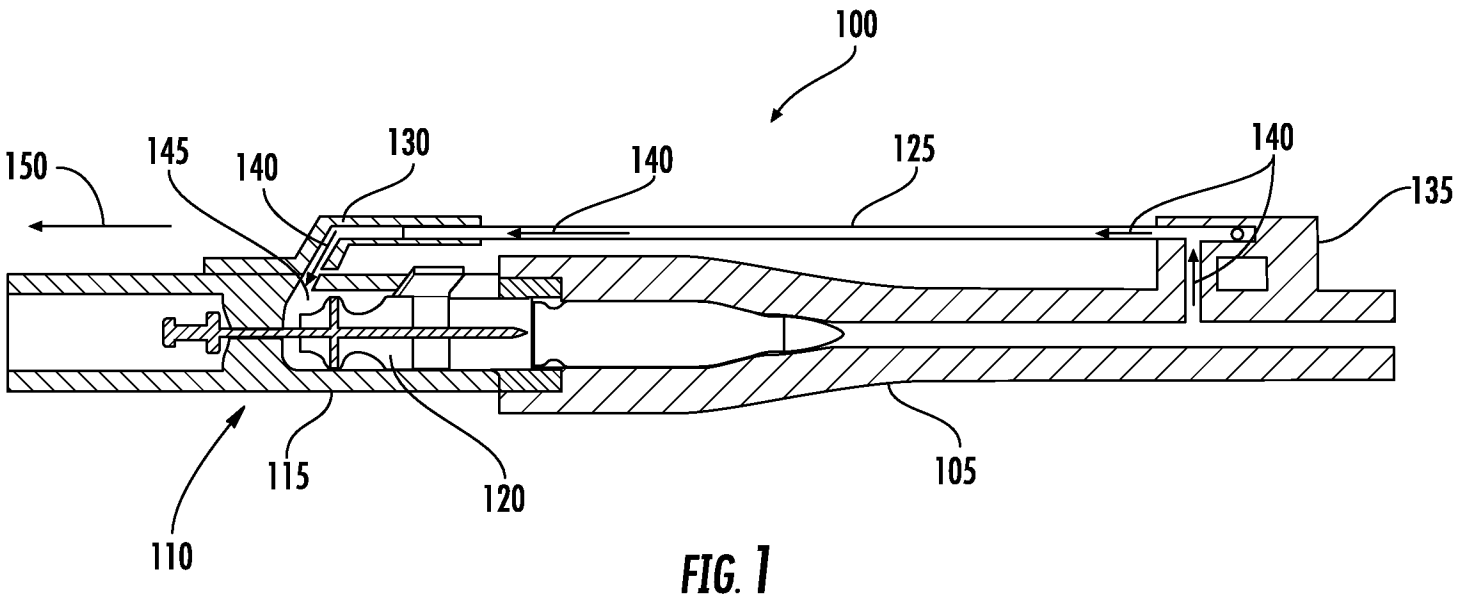

Having thus described the presently disclosed subject matter in general terms, reference will now be made to the accompanying Drawings, which are not necessarily drawn to scale, and wherein:

FIG. 1 is a view of a standard AR-15 firearm gas impingement system.

FIG. 2A-2F shows an improved gas impingement system for an automatic and/or semi-automatic firearm according to various embodiments of the invention.

DETAILED DESCRIPTION OF THE INVENTION

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof.

The bolt carrier impingement system of the invention is designed and operates to redirect gases such that they bypass the interior of the bolt carrier assembly, thereby preventing the buildup of carbon and debris thereon. The system redirects the gas through a bypass duct located/formed in the bolt carrier, which bypasses the normal impingement chamber typically located directly behind the bolt located in the interior of the bolt carrier assembly. In a standard gas impingement system, gas is vented directly into this impingement chamber, and which fills up with gas having carbon and debris particles which comes into direct contact with the bolt and bolt carrier. Over time the carbon and debris builds up on the bolt and carrier, and slowing down and potentially stopping the operation of the bolt and carrier, therefore causing the firearm to fail. However, by bypassing the interior of the bolt carrier assembly, as disclosed by the invention herein, no gas enters the interior of the bolt carrier assembly; therefore there is no carbon and debris build up on any moving parts of the bolt and carrier, which will keep the firearm operating longer and more reliably.

The operation of standard automatic and semiautomatic firearms, such as an AR-15, is well understood and known, and therefore is not further described in detail herein.

FIG. 1 illustrates a standard gas impingement system 100 of an AR-15 firearm. The gas impingement system 100 includes a barrel 105, a bolt carrier assembly 110 (including bolt carrier 115 and bolt 120), a gas tube 125, a gas key 130, and a gas block 135. In operation, hot high pressure propellant gas from a discharged round, is routed through gas block 135, along gas tube 125, through gas key 130, and into an interior region of the bolt carrier assembly 110, i.e., directly behind bolt 125 into impingement chamber 145 (as shown by arrows 140). The discharged propellant gas drives bolt carrier assembly 110 rearward in the direction of arrow 150 into its recoil position. The gas is then vented out of the interior of bolt carrier assembly 110 via gas exhaust vents (not shown). This hot, high pressure propellant gas comes into direct contact with the interior of bolt carrier assembly 110 (i.e., bolt carrier 115 and bolt 120) and contaminates the interior with carbon and debris particles, coating bolt carrier 115 and bolt 120 with the carbon residue and debris particles. The high temperature of the gas may also accelerate the breakdown of the lubricants and coatings therein. Overtime this may cause extensive component wear and potentially causing a malfunction, e.g., jam, thus decreasing the reliability and shortening the operation life of the firearm.

FIGS. 2A-2F illustrates a bolt carrier impingement system 200 in accordance with various embodiments of the invention. Bolt carrier impingement system 200, in one embodiment, may include barrel 105, bolt carrier assembly 110 (including bolt carrier 115 and bolt 120), gas tube 125, gas key 130, gas block 135 (see FIG. 1), gas key tube 137, and bypass duct 205. Gay key 130 and bolt carrier 115 may be separate pieces or a single piece, e.g., monolithic. Bypass duct 205 may vent directly to the exterior of the carrier assembly 110. Bypass duct 205 may further include an adjustable vent 210, which may include orifices 215 and adjustment mechanism 220. Orifices 215 may be of varying number and sizes calibrated to allow for venting varying percentages of gas flow from bypass duct 205 in the range of 0% to 100%, e.g., 0%, 25%, 50%, 75%, 100%. The desired percentage of gas flow vented from bypass duct 205 may be varied and calculated depending on the particular powder load of the round being fired. For example, a high powder round may require a higher percentage of gas flow to be vented from bypass duct 205 for proper operation of the bolt carrier assembly 110 to cycle the firearm, i.e., driving back the bolt carrier assembly ejecting the spent shell. Adjustment mechanism 220 may be any suitable adjustment mechanism, such as a rotatable dial. Adjustment mechanism 220 may be adjusted using any suitable mechanism, for example, using a coin slot to rotate adjustment mechanism 220. In one example, an operator of the firearm may adjust the adjustment mechanism 210 such that the appropriate one of orifices 215 is aligned with bypass duct 205, thus allowing the appropriate percentage of gas flow to be vented from bypass duct 205 based on the particular powder load of the round to be fired. In one example, adjustment mechanism 220, such as a rotatable dial, may be operably secured to the bolt carrier assembly 110 via a bolt (e.g., shown as 221), or other suitable mechanism for operably securing adjustment mechanism 220 to bolt carrier assembly 110.

In operation, hot high pressure propellant gas from a discharged round is routed in the direction of arrows 140, through gas block 135 (see FIG. 1), along gas tube 125, into gas tube key 137 and through a gas passage way 223 of gas key 130, and into bypass duct 205. The propellant gas may then vent directly out of bypass duct 205, or if adjustable vent 210 is employed, via one or more of orifices 215. Bypass duct 205 bypasses impingement chamber 145 altogether, thus the propellant gas never enters the interior area of the bolt carrier assembly 110, thus preventing the bolt carrier 115 and bolt 120 from being contaminated by carbon and debris particles, as well as from being exposed to the high temperature gas.

In a preferred embodiment, bypass duct 205 is routed through a portion of bolt carrier 115 such that it bypasses the interior area of bolt carrier assembly 110. In one example, bypass duct 205 may be formed in bolt carrier 110 (e.g., formed between an inner surface and exterior surface), connecting the formed bypass duct 205 to gas passage way 223 of gas key 130, such that the gas may pass from the gas key 130 through the bypass duct 205 and then exit the bolt carrier assembly 110 to an exterior of the firearm, without entering the interior area of the bolt carrier assembly 110, thus avoiding contact with the bolt 120 and interior of bolt carrier 115. Gas passage way 223 of gas key 130 may include one or more angles and/or surfaces that impinge the gas to actuate bolt carrier assembly 110 causing it to cycle.

Gas key tube 137 may be removable, and in one embodiment, it may be held in place by a pin 139, such as a roll pin or the like. Gas key tube 137 may be configured to fit within gas key 130 and connect with gas tube 125 to form a portion of gas passage way 223. Gas key tube 137 may further include a port 141 to allow the propellant gas to pass through the remaining portion of gas passage way 223, and through bypass duct 205

Bypass duct 205 and/or all, or portions of, gas passage way 223 may be formed (e.g., milled/drilled out) by milling tunnels and/or vents in gas key 130 and/or bolt carrier 115. The milled tunnels and/or vents may be milled through gas key 130 by creating one or more access holes, e.g., access holes 143, therein. The access holes 143 created in gas key 130 to mill the tunnels and/or vents of the bypass duct 205 and/or gas passage way 223, may be plugged by one or more plugs 245 (see FIGS. 2B-2F), alternatively one or more of the access holes may be left unplugged. In one embodiment, access holes 143 are operatively closed off by a wall of gas key tube 137 when installed in gas key 130. Plugs 245 may be in the range of about 8-32 to about ¼"-28, or other suitably sized plugs.

Gas passage way 223 and bypass duct 205 may be configured and routed through the bolt carrier 115 in a number of varying configurations as illustrated in the non-limiting examples shown in FIGS. 2A-2F.

Figure 2A:
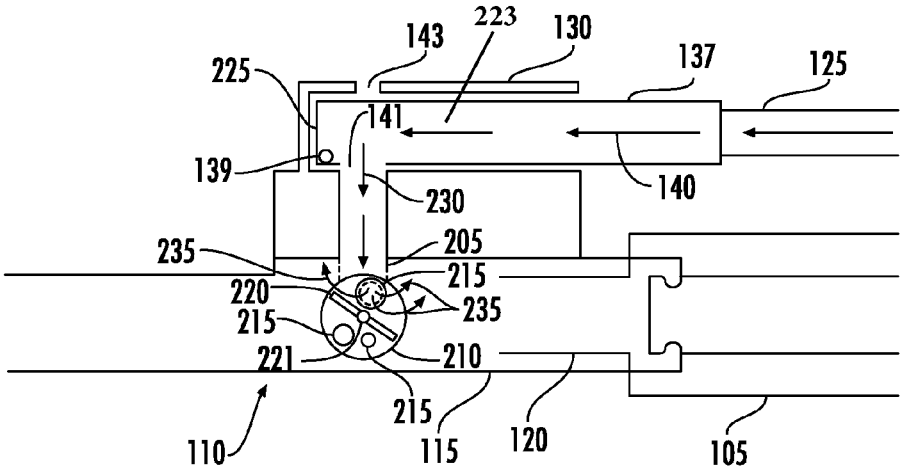

In FIG. 2A gas passage way 223 and bypass duct 205 are configured such that the discharged propellant gas of a fired round enters gas tube 125 (e.g., by exiting barrel 105 through a vent into gas block 135, which is connected to gas tube 125). The discharged propellant gas then flows through gas tube 125, into gas key tube 137 and gas passage way 223 of gas key 130 as shown by arrows 140. The discharged propellant gas then may impinge a back wall 225 of gas passage way 223. In an alternative embodiment, one end of gas key tube 137 may be closed (e.g., the end abutting back wall 225), and in such an embodiment the discharged propellant gas would then impinge on the interior surface of the closed end of gas key tube 137. As further shown by arrows 230, the discharged propellant gas passes through the remaining gas passage way 223, and through bypass duct 205. The discharged propellant gas may then be vented out of the firearm directly, or in an embodiment employing adjustable vent 210, through one of the one or more orifices 215, as shown by arrows 235, without any of the discharged propellant gas entering the interior area of the bolt carrier assembly 110, thus avoiding contact with the bolt 120 and interior of bolt carrier 115. In this embodiment, the discharged propellant gas may impinge against back wall 225 causing the bolt carrier to cycle. In one embodiment, employing adjustable vent 210, the firearm operator may adjust adjustable vent 210 based on the particular powder load of the round to be fired to provide for the proper percentage of discharged propellant gas to be vented for optimum cycling of the bolt carrier for proper operation of the firearm.

Figure 2B:
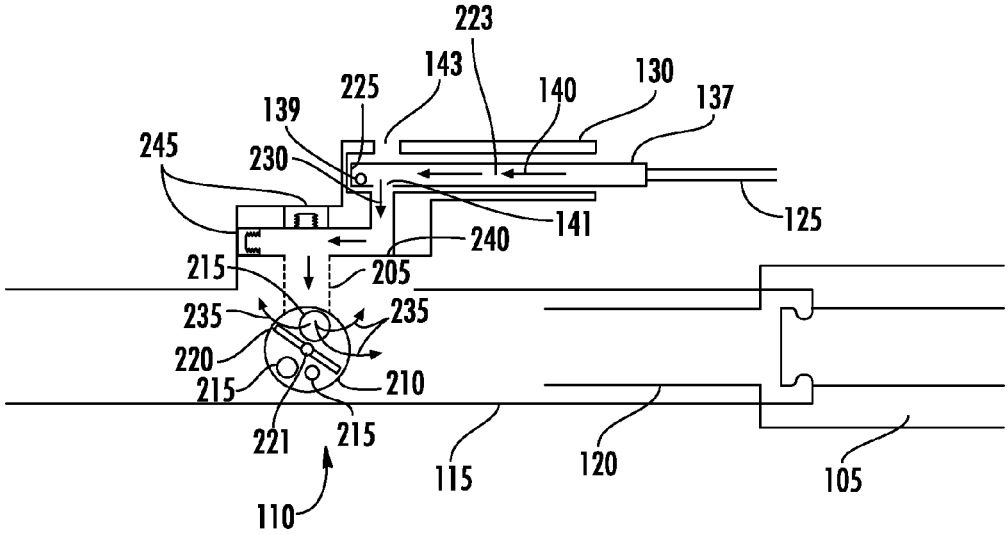

In FIG. 2B gas passage way 223 and bypass duct 205 are configured such that the discharged propellant gas of a fired round enters gas tube 125 (e.g., by exiting barrel 105 through a vent into gas block 135, which is connected gas tube 125). The discharged propellant gas then flows through gas tube 125, into gas key tube 137 and gas passage way 223 of gas key 130 as shown by arrows 140. The discharged propellant gas then may impinge a back wall 225 of gas passage way 223. In an alternative embodiment, one end of gas key tube 137 may be closed (e.g., the end abutting back wall 225), and in such an embodiment the discharged propellant gas would then impinge on the interior surface of the closed end of gas key tube 137. As further shown by arrows 230 the discharged propellant gas may then pass through another section of gas passage way 223. The discharged propellant gas may then be directed by angled section 240 to pass through the remaining gas passage way 223, and into bypass duct 205. The discharged propellant gas may then be vented out of the firearm directly, or if adjustable vent 210 is employed, through one of the one or more orifices 215, as shown by arrows 235, without any of the discharged propellant gas entering the interior area of the bolt carrier assembly 110, thus avoiding contact with the bolt 120 and interior of bolt carrier 115. Angled section 240 may be at an angle in the range of about 90°. In this embodiment the discharged propellant gas impinges against one or more of back wall 225 and second angled section 240, causing the bolt carrier to cycle. In one embodiment, employing adjustable vent 210, the firearm operator may adjust adjustable vent 210 based on the particular powder load of the round to be fired to provide for the proper percentage of discharged propellant gas to be vented for optimum cycling of the bolt carrier for proper operation of the firearm.

Gas key 130 may further include one or more plugs 245 which plug the one or more access holes 143 created in gas key 130 to mill the tunnels and/or vents of the bypass duct 205 and/or gas passage way 223. In one embodiment, plugs 245 may be removable for accessing gas passage way 223 and/or bypass duct 205 for maintenance purposes, e.g., cleaning and/or repair.

Figure 2C:
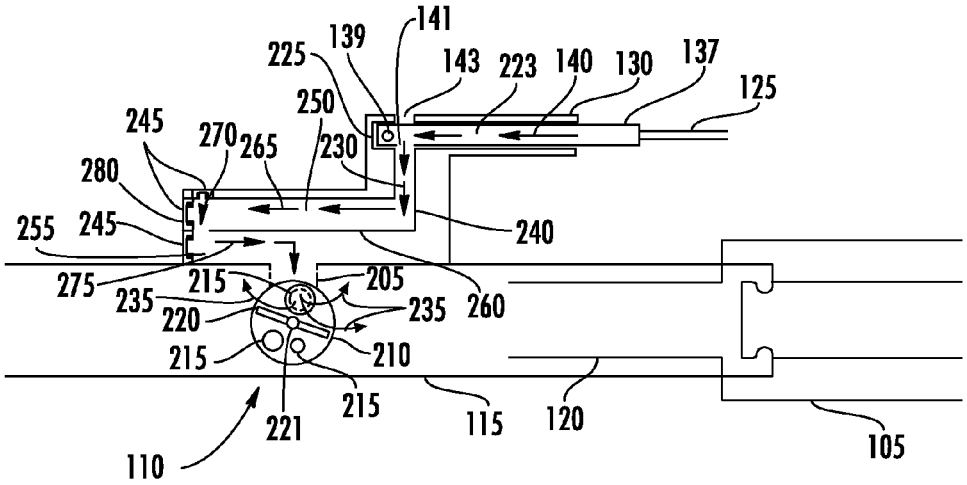

In FIG. 2C gas passage way 223 and bypass duct 205 are configured such that the discharged propellant gas of a fired round enters gas tube 125 (e.g., by exiting barrel 105 through a vent into gas block 135, which is connected gas tube 125). The discharged propellant gas then flows through gas tube 125, into gas key tube 137 and gas passage way 223 of gas key 130 as shown by arrows 140. The discharged propellant gas then impinges a back wall 225 of gas passage way 223 in gas key 130. In an alternative embodiment, one end of gas key tube 137 may be closed (e.g., the end abutting back wall 225), and in such an embodiment the discharged propellant gas would then impinge on the interior surface of the closed end of gas key tube 137. As further shown by arrows 230 the discharged propellant gas may then pass through a second section including angled section 240 of gas passage way 223. In this embodiment a portion of gas passage way 223 may be divided into an upper passage way 250 and a lower passage way 255, separated by a partition 260. The discharged propellant gas may be directed rearward through upper passage way 250 (as shown by arrows 265), through a port 270, and into lower passage way 255, where the discharged propellant gas travels back in a forward direction to bypass duct 205, as shown by arrows 275. The discharged propellant gas may then be vented out of the firearm through bypass duct 205 directly, or if adjustable vent 210 is employed, through one of the one or more orifices 215, as shown by arrows 235, without any of the discharged propellant gas entering the interior area of the bolt carrier assembly 110, thus avoiding contact with the bolt 120 and interior of bolt carrier 115. Angled section 240 may be at an angle in the range of about 90°. In this embodiment the discharged propellant gas impinges against one or more of back wall 225, which assists the bolt carrier to cycle. The discharged propellant gas impinging against a rear wall 280 of gas key 130 may further facilitate the bolt carrier to cycle properly.

In one embodiment, employing adjustable vent 210, the firearm operator may adjust adjustable vent 210 based on the particular powder load of the round to be fired to provide for the proper percentage of discharged propellant gas to be vented for optimum cycling of the bolt carrier for proper operation of the firearm.

Gas key 130 may further include one or more plugs 245 which plug one or more access holes 143 created in gas key 130 to mill the tunnels and/or vents of the bypass duct 205 and/or gas passage way 223. In one embodiment, plugs 245 may be removable for accessing gas passage way 223 and/or bypass duct 205 for maintenance purposes, e.g., cleaning and/or repair.

Figure 2D:
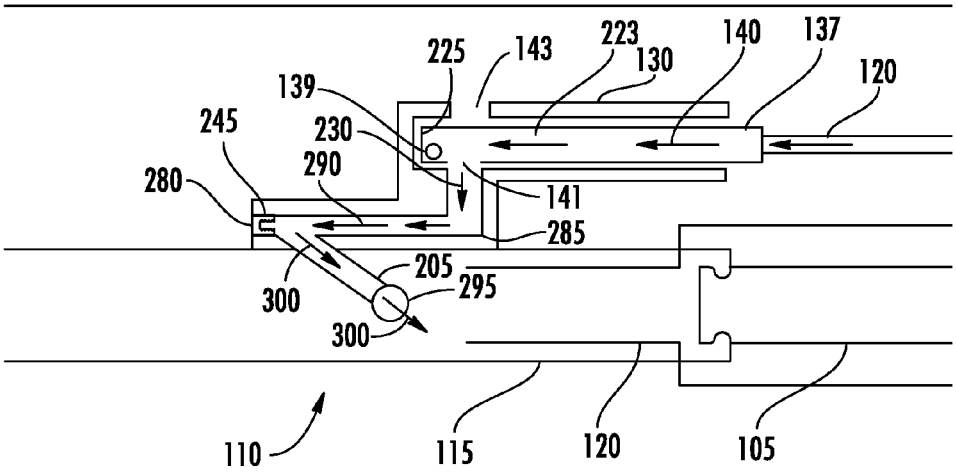

In FIG. 2D gas passage way 223 and bypass duct 205 are configured such that the discharged propellant gas of a fired round enters gas tube 125 (e.g., by exiting barrel 105 through a vent into gas block 135, which is connected gas tube 125). The discharged propellant gas then flows through gas tube 125, into gas key tube 137 and gas passage way 223 of gas key 130 as shown by arrows 140. The discharged propellant gas then impinges a back wall 225 of gas passage way 223. In an alternative embodiment, one end of gas key tube 137 may be closed (e.g., the end abutting back wall 225), and in such an embodiment the discharged propellant gas would then impinge on the interior surface of the closed end of gas key tube 137. As further shown by arrows 230 the discharged propellant gas may then pass through a second section of gas passage way 223. The discharged propellant gas may then be directed at angled section 285 rearward through the remaining gas passage way 223, toward bypass duct 205, as shown by arrow 290, and then through a downward angled section toward bypass duct 205, as shown by arrow 300. Rear wall 280 of gas key 130 may further help direct the discharged propellant gas in the direction of arrows 300 and into bypass duct 205. The discharged propellant gas may then be vented out of the firearm through bypass duct 205, for example, via orifice 295, as shown by arrows 300, without any of the discharged propellant gas entering the interior area of the bolt carrier assembly 110, thus avoiding contact with the bolt 120 and interior of bolt carrier 115. Angled section 285 may be at an angle in the range of about 90. In this embodiment the discharged propellant gas impinges against back wall 225 assisting in causing the bolt carrier to cycle. The discharged propellant gas impinging against rear wall 280 of gas key 130 may further facilitate the bolt carrier to cycle properly.

Gas key 130 may further include one or more plugs 245 which plug the one or more access holes created in gas key 130 to mill the tunnels and/or vents of the bypass duct 205 and/or gas passage way 223. In one embodiment, plugs 245 may be removable for accessing gas passage way 223 and/or bypass duct 205 for maintenance purposes, e.g., cleaning and/or repair.

Figure 2E:
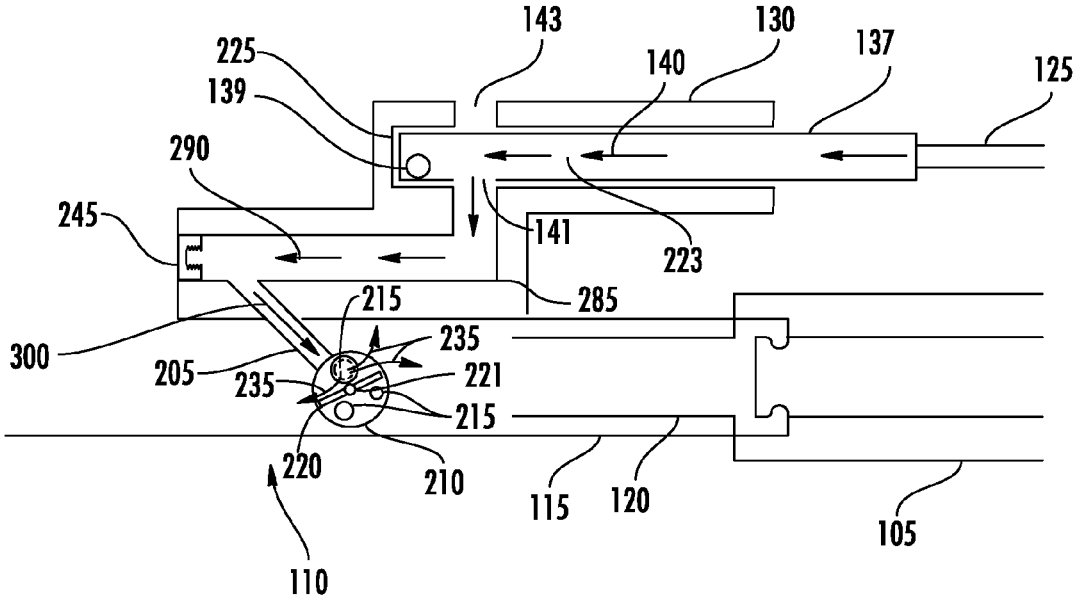

In FIG. 2E gas passage way 223 and bypass duct 205 are configured in a similar manner as that shown is FIG. 2D and further may include adjustable vent 210. The discharged propellant gas may be vented out of the firearm through bypass duct 205 via one of the one or more orifices 215, as shown by arrows 235, without any of the discharged propellant gas entering the interior area of the bolt carrier assembly 110, thus avoiding contact with the bolt 120 and interior of bolt carrier 115. The firearm operator may adjust adjustable vent 210 based on the particular powder load of the round to be fired to provide for the proper percentage of discharged propellant gas to be vented for optimum cycling of the bolt carrier for proper operation of the firearm. Adjustable vent 210 may be adjusted using adjustment mechanism 220.

Figure 2F:
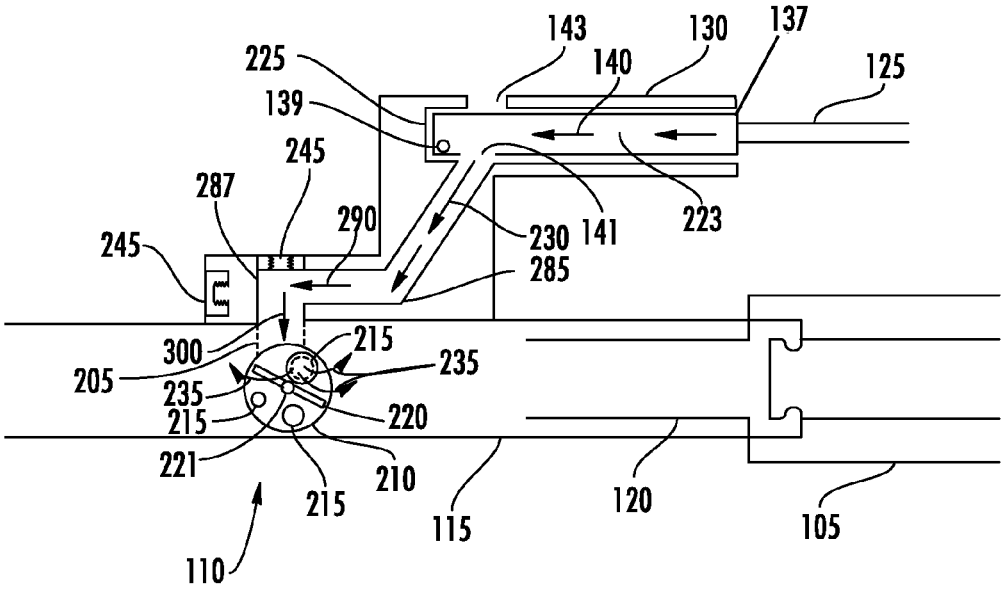

In FIG. 2F gas passage way 223 and bypass duct 205 are configured such that the discharged propellant gas of a fired round enters gas tube 125 (e.g., by exiting barrel 105 through a vent into gas block 135, which is connected gas tube 125). The discharged propellant gas then flows through gas tube 125, into gas key tube 137 and gas passage way 223 of gas key 130 as shown by arrows 140. The discharged propellant gas then impinges a back wall 225 of gas passage way 223. In an alternative embodiment, one end of gas key tube 137 may be closed (e.g., the end abutting back wall 225), and in such an embodiment the discharged propellant gas would then impinge on the interior surface of the closed end of gas key tube 137. As further shown by arrows 230 the discharged propellant gas may then pass through an angle section 285 of gas passage way 223. The discharged propellant gas may then be directed rearward through gas passage way 223 as shown by arrow 290, and then through a second angled section 287 and toward bypass duct 205, as shown by arrow 300. The discharged propellant gas may then be vented out of the firearm through bypass duct 205 directly, or if adjustable vent 210 is employed, through one of the one or more orifices 215, as shown by arrows 235, without any of the discharged propellant gas entering the interior area of the bolt carrier assembly 110, thus avoiding contact with the bolt 120 and interior of bolt carrier 115. Angled section 285, and/or third angled section 287 may be at an angle in the range of about 90° to about 145°. In this embodiment the discharged propellant gas impinges against back wall 225 and/or one or more of the angled sections (e.g., angled section 285 and/or second angle section 287), assisting the bolt carrier to cycle. The discharged propellant gas impinging against rear wall 280 of gas key 130 may further facilitate the bolt carrier to cycle properly.

Gas key 130 may further include one or more plugs 245 which plug the one or more access holes created in gas key 130 to mill the tunnels and/or vents of the bypass duct 205 and/or gas passage way 223. In one embodiment, plugs 245 may be removable for accessing gas passage way 223 and/or bypass duct 205 for maintenance purposes, e.g., cleaning and/or repair.

Although the foregoing subject matter has been described in some detail by way of illustration and example for purposes of clarity of understanding, it will be understood by those skilled in the art that certain changes and modifications can be practiced within the scope of the description herein.

Following long-standing patent law convention, the terms "a," "an," and "the" refer to "one or more" when used in this application. Thus, for example, reference to "a subject" includes a plurality of subjects, unless the context clearly is to the contrary (e.g., a plurality of subjects), and so forth.

Throughout this specification, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

I claim:

1. A bolt carrier gas impingement system, comprising:

a. a bolt carrier assembly, comprising:

i. a bolt carrier; and ii. a bolt;

b. a gas key, comprising a gas passageway;

c. a gas tube configured for routing gas from a discharged round to the gas passageway of the gas key;

d. a bypass duct formed in the bolt carrier, wherein the bypass duct is configured to provide a duct between the gas passageway and an exterior of the bolt carrier assembly, such that the discharged gas flows out of the bypass duct without contacting internal components of the bolt carrier assembly; and wherein the bypass duct comprises an adjustable vent operably connected thereto, the adjustable vent comprising:

i. orifices of differing sizes; and ii. an adjustment mechanism configured for selecting between the orifices.

2. The system of claim 1 further comprising a gas key tube disposed such that the gas key tube provides a gas flow connection between the gas tube and the gas passageway of the gas key.

3. The system of claim 1 wherein the internal components of the bolt carrier assembly comprises the bolt and internal surfaces of the bolt carrier.

4. The system of claim 1 wherein the orifices are configured such that when one of the orifices is selected using the adjustment mechanism the selected orifice aligns with an exit end of the bypass duct.

5. The system of claim 1 wherein the orifices sizes are calibrated to allow for venting in the range of 0% to 100% of the discharged gas from the bypass duct.

6. The system of claim 5 wherein the percentage of discharged gas to be vented is calibrated to achieve proper actuation of the bolt carrier assembly based on a particular powder load of a round to be fired.

7. The system of claim 1 wherein the adjustment mechanism comprises three orifices of differing sizes.

8. The system of claim 1 wherein the adjustment mechanism comprises four orifices of differing sizes.

9. The system of claim 1 wherein the adjustment mechanism comprises an adjustment dial.

10. The system of claim 1 wherein the gas passage way comprise one or more angled sections, wherein the discharged gas impinges against at least one of the one or more angled sections facilitating actuation of the bolt carrier assembly.

11. The system of claim 10 wherein the one or more angled sections are in the range of about 45° to about 145° from horizontal.

12. The system of claim 10 wherein the one or more angled sections are in the range of about 90° to about 145° from horizontal.

13. The system of claim 1 wherein the gas key comprises a portion having an upper passage way and a lower passage way, wherein the upper and lower passage ways are separated by a partition, and wherein the partition comprises a port allowing the discharged gas to flow therethrough.

14. The system of claim 1 wherein the gas key comprising one or more access hole plugs.

15. A firearm, comprising:

a. bolt carrier gas impingement system, comprising:

i. a bolt carrier assembly, comprising:

i. a bolt carrier; and ii. a bolt;

ii. a gas key, comprising a gas passageway;

iii. a gas tube configured for routing gas from a discharged round to the gas passageway of the gas key;

iv. a bypass duct formed in the bolt carrier, wherein the bypass duct is configured to provide a duct between the gas passageway and an exterior of the bolt carrier assembly, such that the discharged gas vents out of the bypass duct without coming into contact with the bolt; and wherein the bypass duct comprises an adjustable vent operably connected thereto, the adjustable vent comprising:

i. orifices of differing sizes; and ii. an adjustment mechanism configured for selecting between the orifices.

16. The firearm of claim 15 wherein the firearm is an automatic and semi-automatic firearm.

17. The firearm of claim 15 wherein the bolt carrier gas impingement system further comprises a gas key tube disposed such that the gas key tube provides a gas flow connection between the gas tube and the gas passageway of the gas key.

18. A method of actuating a bolt carrier assembly, comprising:

a. providing a bolt carrier gas impingement system;

b. routing discharged gas from a discharged round along a gas passageway;

c. impinging the discharged gas against an angled portion of the gas passageway actuating the bolt carrier assembly;

d. venting the discharged gas externally of the bolt carrier assembly via a bypass duct, wherein the bypass duct is configured to bypass the internal components of the bolt carrier assembly such that the discharged gas does not contact internal components of the bolt carrier assembly; and wherein the bypass duct comprises an adjustable vent operably connected thereto, the adjustable vent comprising:

i. orifices of differing sizes; and ii. an adjustment mechanism configured for selecting between the orifices.

19. The method of claim 18 wherein the internal components of the bolt carrier assembly comprise a bolt and internal surfaces of a bolt carrier.

* * * * *